US007010948B1

(12) United States Patent
Hsieh

(10) Patent No.: US 7,010,948 B1
(45) Date of Patent: Mar. 14, 2006

(54) REMOTE-CONTROLLED LOCK

(76) Inventor: Hui-Hua Hsieh, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 11/113,007

(22) Filed: Apr. 25, 2005

(51) Int. Cl.
*E05B 47/06* (2006.01)

(52) U.S. Cl. ..... 70/257; 70/277; 70/278.7; 292/144

(58) Field of Classification Search ..... 70/257, 70/277, 278.6, 278.7, 279.1, 280–283, 283.1; 292/144
See application file for complete search history.

(56) References Cited

U.S. PATENT DOCUMENTS 4,702,095 A * 10/1987 Ben-Asher ..... 70/279.1
6,330,817 B1 * 12/2001 Frolov ..... 70/280
6,619,085 B1 * 9/2003 Hsieh ..... 70/257
6,813,916 B1 * 11/2004 Chang ..... 70/257
6,867,685 B1 * 3/2005 Stillwagon ..... 340/5.64
6,892,557 B1 * 5/2005 Bieniek ..... 70/278.7
6,919,797 B1 * 7/2005 Hsieh ..... 340/426.13
2002/0033606 A1 * 3/2002 Kimoto et al. ..... 292/144
2003/0070458 A1 * 4/2003 Huang ..... 70/283
2003/0071470 A1 * 4/2003 Yeh ..... 292/144
2005/0011238 A1 * 1/2005 Roberge ..... 70/256

* cited by examiner

*Primary Examiner*—Lloyd A. Gall

(57) ABSTRACT

A remote-controlled lock includes a bottom base, a transmission motor, a connecting rod, a slide member, a deadbolt, a coil spring and a casing. By pressing the unlocking press button of a remote controller, the transmission motor is started to rotate clockwise and actuate he connecting rod and the slide member to rotate to let the slide member no longer stopped by the engage block on the bottom base. Thus, the slide member and the deadbolt can be moved inward to unlock the remote-controlled lock. On the contrary, press the locking press button of a remote controller to start the transmission motor to rotate counterclockwise and actuate the connecting rod and the slide member to rotate reversely to let the engage block engaged en the engage groove to stop the slide member from moving inward, thus locking the remote-controlled lock.

3 Claims, 7 Drawing Sheets

REMOTE-CONTROLLED LOCK

BACKGROUND OF THE INVENTION

1. Field of the Invention

This invention relates to a remote-controlled lock, particularly to one composed of a bottom base, a transmission motor, a connecting rod, a slide member, a deadbolt, a spring and a casing. To unlock the remote-controlled lock, only press the unlocking press button of a remote controller to start the transmission motor to rotate clockwise and actuate the connecting rod to rotate reversely together with the slide member to let the notch of the slide member aligned to the engage block on the bottom base and the slide member no longer stopped by the engage block. Thus, the slide member together with the deadbolt can be moved inward to compress the spring to perform unlocking of the remote-controlled lock. On the contrary, to lock the remote-controlled lock, simply press the locking press button of the remote controller to start the transmission motor to rotate counterclockwise and actuate the connecting rod and the slide member to rotate reversely to let the engage block engaged in the engage groove of the slide member to stop the slide member from being moved inward, thus finishing locking of the remote-controlled lock.

2. Description of the Prior Art

A conventional door lock, as shown in FIG. 1, includes a housing 10 provided inside with a lock base 11. The lock base 11 is provided at one side with lock rods 110 able to extend out of through holes 100 in the sidewall of the housing 10 and be inserted in an elongate groove 141 in the sidewall of a bolt base 140 on a doorjamb 14. Besides, the lock base 11 has a lock core 111 with a keyhole 112 provided respectively at the inner and the outer side. A pull plate 12 is fitted in the inner side wall of the housing 10, having a fixing plate 120 inserted in the guide rail 101 of the housing 10 and contacting the fixing plate 102 of the housing 10. In addition, the housing 10 is provided inside with a deadbolt 13 having one end inserted through the fixing plate 102 of the housing 10 and secured with the fixing plate 120 of the pull plate 12, with a spring 130 fitted around one end of the deadbolt 13 near the pull plate 12. The deadbolt 13 has the other end fixed with a stopper 131 able to extend out of a through hole 103 in the sidewall of the housing 10 and be inserted in the elongate groove 141 in the sidewall of the bolt base 140 of the doorjamb 14. Thus, a key is inserted in the keyhole 112 of the lock core 111 and turned around to drive the lock rods 110 and the stopper 131 to move inward toward the housing 10 and be disengaged from the elongate groove 141 of the bolt base 140 of the doorjamb 14 to perform unlocking of a door lock.

However, a conventional door lock has its lock rods 110 locked only by a key, therefore it is easy to be unlocked by common unlocking tools, hardly having the effect of anti-theft.

SUMMARY OF THE INVENTION

The objective of the invention is to offer a remote-controlled lock controlled to be locked or unlocked by a remote controller, having excellent effect of anti-theft.

The remote-controlled lock in the present invention includes a bottom base, a transmission motor, a connecting rod, a slide member, a deadbolt, a spring and a casing combined together. The bottom base is provided thereon with a motor holder, a holding member formed with an accommodating groove having an insert hole in its sidewall, and an engage block. The transmission motor is installed on the motor holder of the bottom base. The connecting rod fitted on the rotating shaft of the transmission motor has the opposite walls of its outer end respectively fixed with a projecting stud. The slide member assembled on the connecting rod has its rear wall cut with two opposite lengthwise slide grooves for the two projecting studs of the connecting rod to be respectively positioned therein. The slide member further has its outer circumferential wall cut with an annular engage groove and its front portion bored with a notch. The deadbolt is inserted in a recessed hole in the front portion of the slide member and positioned in the accommodating groove of the holding member on the bottom base. The spring is fitted on the deadbolt and the casing is assembled on the bottom base.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
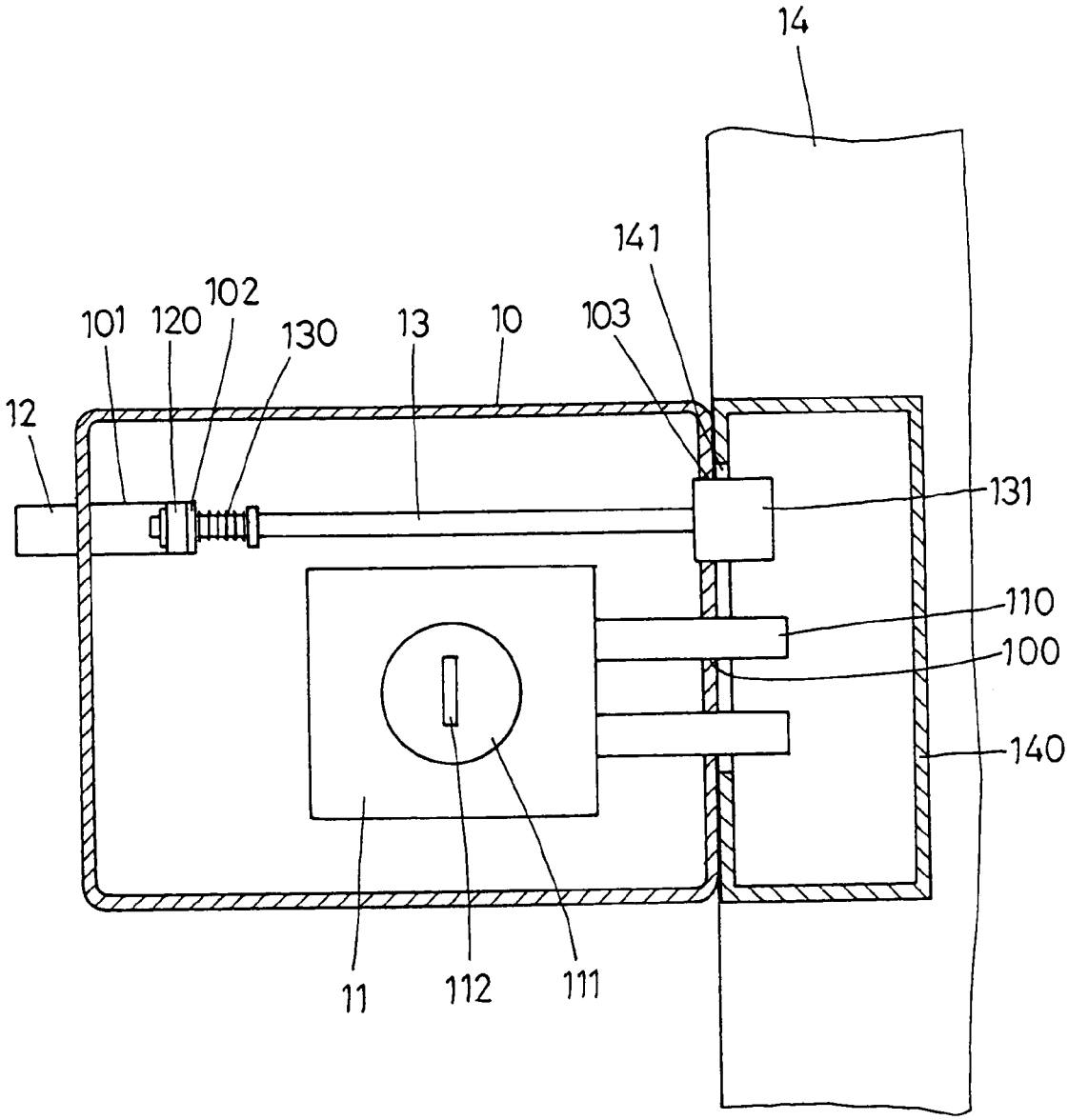
FIG.1 (PRIOR ART)
FIG. 1 is a cross-sectional view of a conventional door lock.
Figure 2:
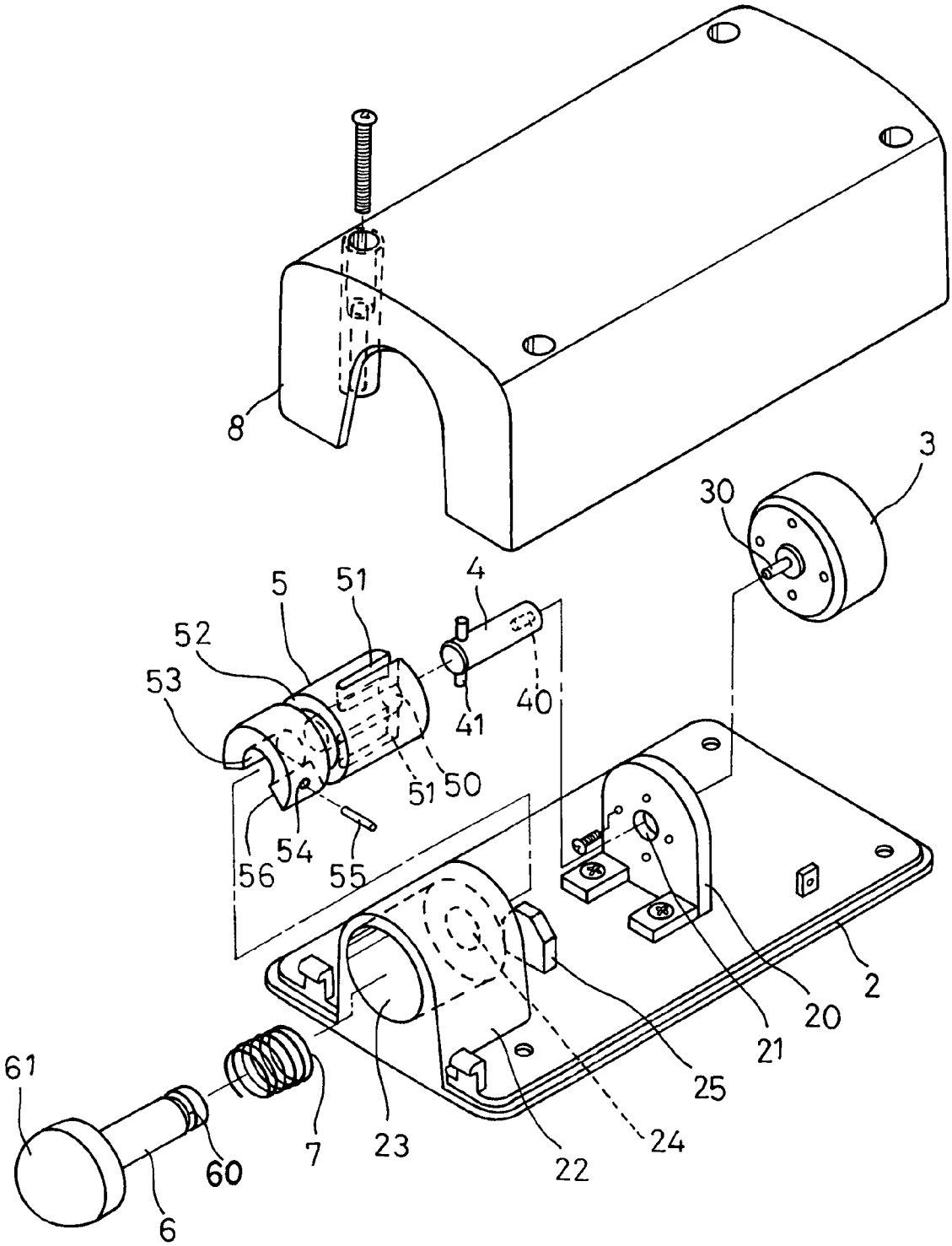
FIG. 2 is an exploded perspective view of a remote-controlled lock in the present invention.

A preferred embodiment of a remote-controlled lock in the present invention, as shown in FIG. 2, includes a bottom base 2, a transmission motor 3, a connecting rod 4, a slide member 5, a deadbolt 6, a coil spring 7 and a casing 8 combined together.

The bottom base 2 is assembled with a motor holder 20 placed on an intermediate portion of an upper surface and having a shaft hole 21, a holding member 22 placed on the left side of the upper surface and formed with an accommodating groove 23 having one side bored with an insert hole 24, and an engage block 25 located behind the holding member 22.

The transmission motor 3 is positioned on the motor holder 20 of the bottom base 2, having its rotating shaft 30 inserted through the shaft hole 21 of the motor holder 20.

The connecting rod 4 fitted on the rotating shaft 30 of the transmission motor 3 has one end bored with a shaft hole 40 and the opposite walls of the other end respectively fixed with a projection 41.

The slide member 5 assembled on the connecting rod 4 has its rear portion formed with an accommodating chamber 50 and its rear opposite walls respectively cut with a lengthwise slide groove 51 passing through the accommodating chamber 50. Further, the slide member 5 has its outer circumferential wall bored with an annular engage groove 52 and its front portion formed with a recessed hole 53. Furthermore, the slide member 5 has its front-end wall bored with a pinhole 54 for an insert pin 55 to be inserted therein and its front portion cut with a notch 56.

The deadbolt 6 is inserted in the recessed hole 53 at the front inner portion of the slide member 5 and positioned in the accommodating groove 23 of the holding member 22 on the bottom base 2, having the outer circumferential wall of its inner end formed with an annular groove 60 and a front head 61 formed with an arc-shaped surface.

The coil spring 7 is fitted on the deadbolt 6.

The casing 8 is assembled on the bottom base 2.

Figure 3:
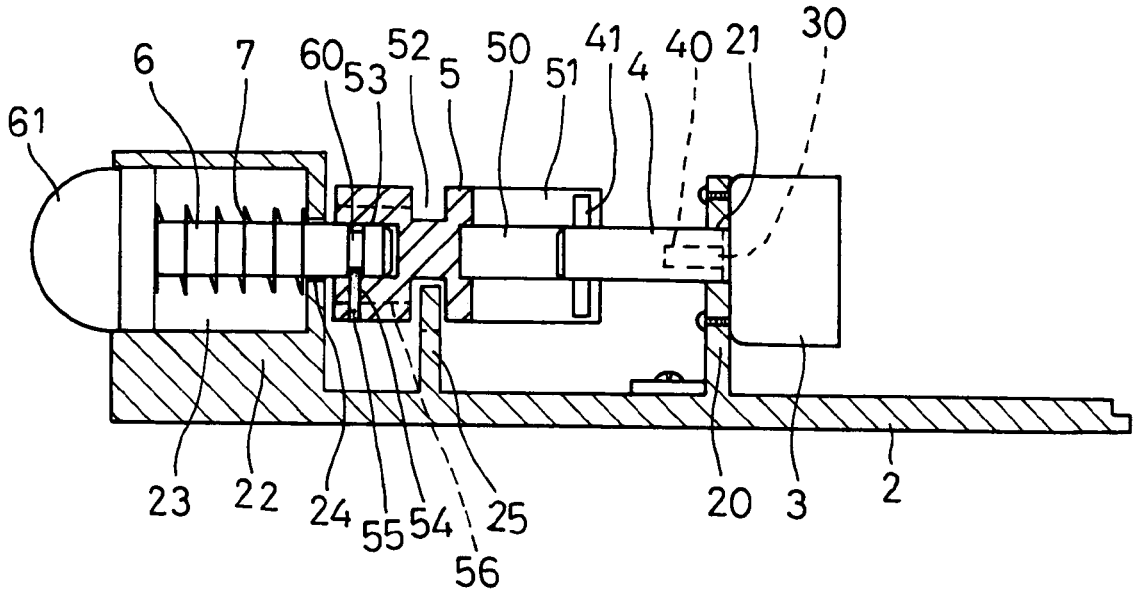
FIG. 3 is a cross-sectional view of the remote-controlled lock in a locked condition in the present invention.
Figure 4:
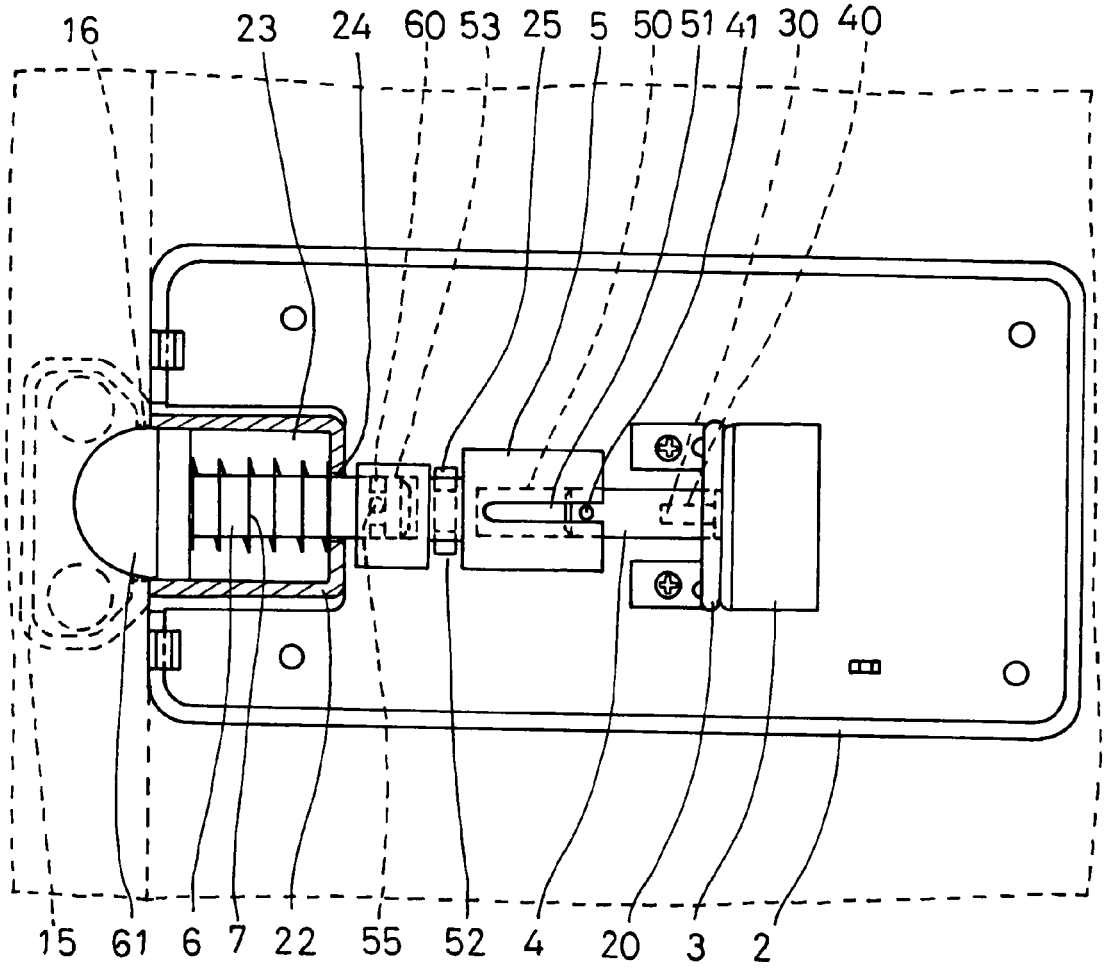
FIG. 4 is an upper cross-sectional view of the remote-controlled lock in the locked condition in the present invention.

In assembling, as shown in FIGS. 2, 3 and 4, firstly, the transmission motor 3 is installed at one side of the motor holder 20 on the bottom base2, letting the rotating shaft 30 of the transmission motor 3 inserted through the shaft hole 21 of the motor holder 20. Next, the connecting rod 4 is fitted on the rotating shaft 30 of the transmission motor 3 and the slide member 5 is assembled on the connecting rod 4, letting the connecting rod 4 inserted in the accommodating chamber 50 of the slide member 5 and the two projections 41 of the connecting rod 4 respectively positioned in the two slide grooves 51 of the slide member 5 to enable the slide member 5 to slide on the connecting rod 4 and the engage block 25 on the bottom base 2 positioned in the annular engage groove 52 of the slide member 5. Subsequently, the coil spring 7 is fitted around the deadbolt 6, which is then inserted in the accommodating groove 23 of the holding member 22 on the bottom base 2. At this time, the deadbolt 6 has its inner end inserted through the insert hole 24 at the inner side of the accommodating groove 23, with its end positioned in the recessed hole 53 of the slide member 5, letting the annular groove 60 of the deadbolt 6 aligned to the pin hole 54 of the slide member 5. Then, the insert pin 55 is inserted through the pin hole 54 of the slide member 5 and positioned in the annular groove 60 of the deadbolt 6 to connect the deadbolt 6 and the slide member 5 together, letting one end of the spring 7 push against the inner side of the front head 61 of the deadbolt 6 and the other end of the spring 7 push against the bottom wall of the accommodating groove 23 of the holding member 22. Finally, the casing 8 is assembled on the bottom base 2 to finish assembly of the remote-controlled lock.

Figure 5:
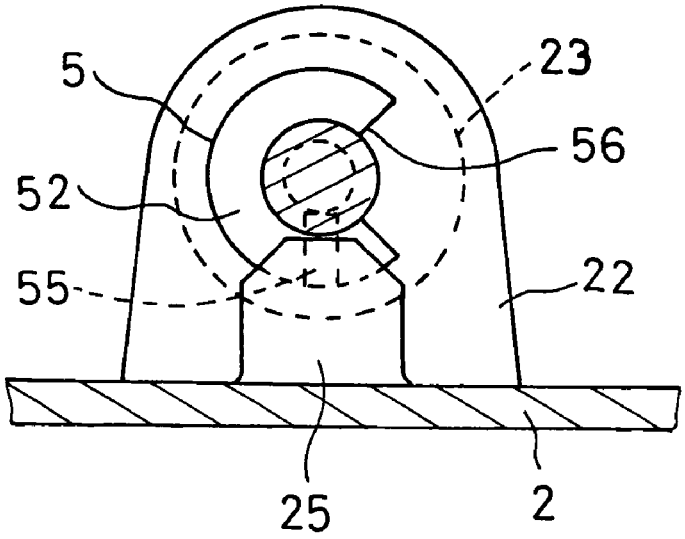
FIG. 5 is a front view of the remote-controlled lock in the locked condition in the present invention.

To lock the remote-controlled lock, as shown in FIGS. 3, 4 and 5, only press the locking press button of a remote controller to start the transmission motor 3 to rotate clockwise and actuate the connecting rod 4 to rotate and synchronously, the connecting rod 4, which has its opposite projections 41 positioned in the slide grooves of the slide member 5, will actuate the slide member 5 to rotate and have its notch 56 moved away from the position where the engage block 25 of the bottom base 2 lies, letting the engage block 25 engaged in the annular engage groove 52 of the slide member 5. Thus, the slide member 5 is stopped by the engage block 25 on the bottom base 2, impossible to be moved inward; therefore, the deadbolt 6, which is connected with the slide member 5, is impossible to be moved inward and has its front head 61 engaged in the engage groove 16 of the engage base 15 of a doorjamb, as shown in FIG. 4, thus performing locking of the remote-controlled lock.

Figure 6:
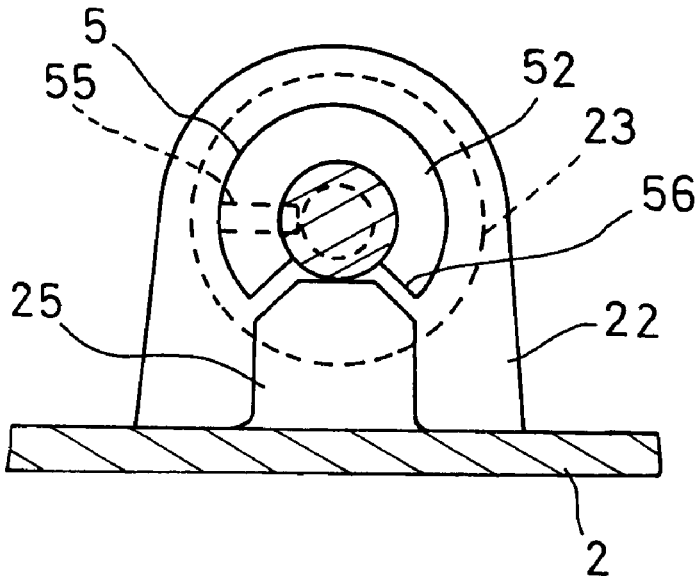
FIG. 6 is a front view of the remote-controlled lock in an unlocked condition in the present invention.
Figure 7:
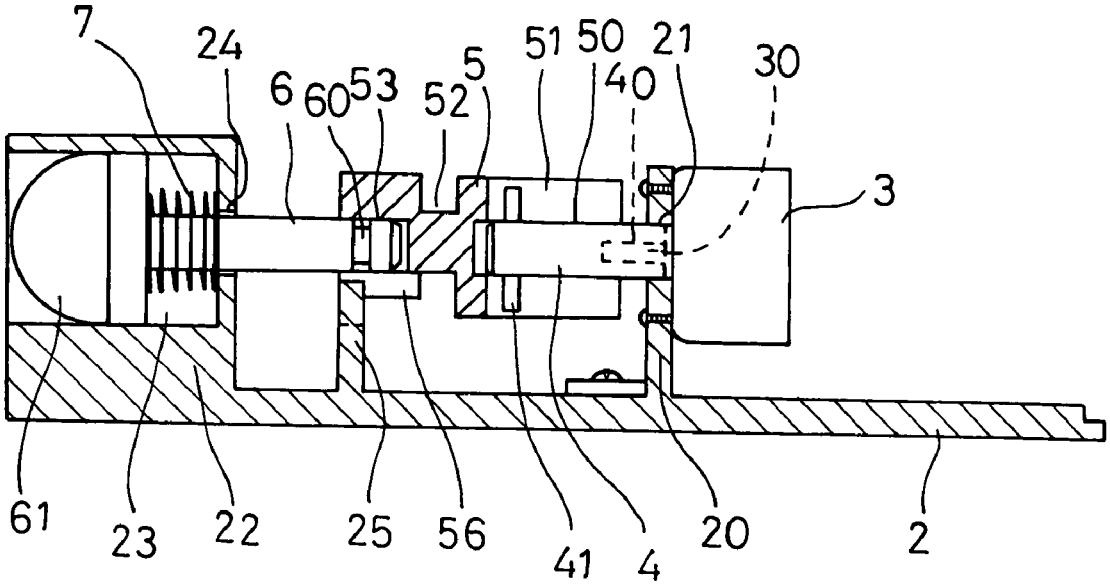
FIG. 7 is a cross-sectional view of the remote-controlled lock in the unlocked condition in the present invention; and, FIG. 8 is an upper cross-sectional view of the remote-controlled lock in the unlocked condition in the present invention.
Figure 8:
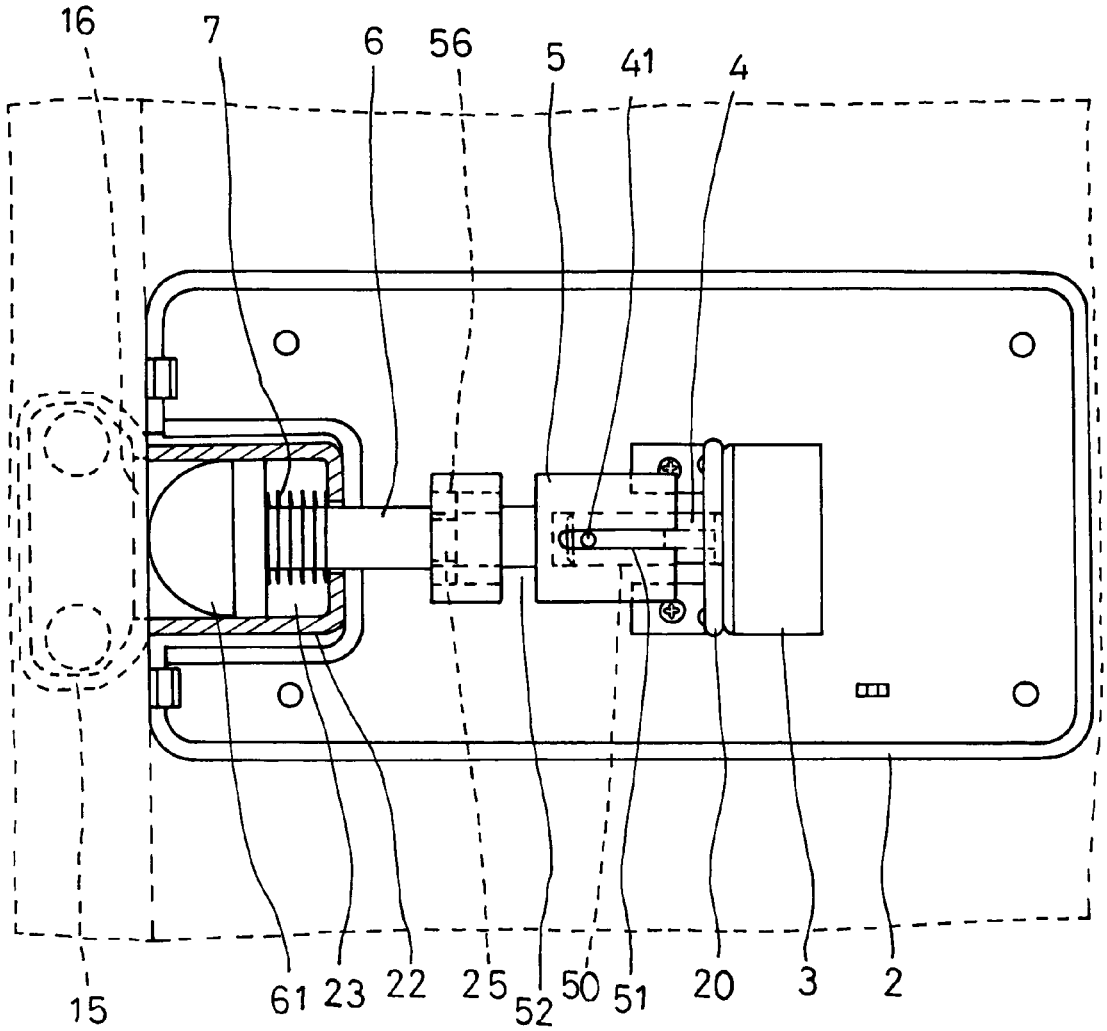

To unlock the remote-controlled lock, as shown in FIGS. 6, 7 and 8, simply press the unlocking press button of the remote controller to start the transmission motor 3 to rotate counterclockwise and actuate the connecting rod 4 to rotate reversely together with the slide member 5 to let the notch 56 of the slide member 5 aligned to the engage block 25 on the bottom base 2 and the engage block 25 disengaged from the annular engage groove 52 of the slide member 5. Thus, the slide member 5 is no longer stopped by the engage block 25 so the slide member 5 and the deadbolt 6 can be moved inward to let the front head 61 of the deadbolt 6 moved inward toward the accommodating groove 23 of the holding member 22 on the bottom base 2, thus performing unlocking of the remote-controlled lock.

While the preferred embodiment of the invention has been described above, it will be recognized and understood that various modifications may be made therein and the appended claims are intended to cover all such modifications that may fall within the spirit and scope of the invention.

What is claimed is:

1. A remote-controlled lock comprising:

a bottom base having a motor holder fixed thereon, said bottom base secured thereon with a holding member having an accommodating groove, said accommodating groove having one side bored with an insert hole, said bottom base further provided thereon with an engage block;

a transmission motor installed with one side of said motor holder on said bottom base;

a connecting rod fitted on said transmission motor, said connecting rod having the opposite walls of one end respectively fixed with a projection;

a slide member assembled on said connecting rod, said slide member having the rear wall cut with two opposite lengthwise slide grooves, said two projections of said connecting rod respectively positioned in said two slide grooves of said slide member, said slide member having its outer circumferential wall cut with an annular groove, said slide member further having its front portion formed with a notch;

a deadbolt having its inner end inserted in a recessed hole in the front portion of said slide member, said deadbolt positioned in said accommodating groove of said holding member on said bottom base;

a coil spring fitted around said deadbolt;

a casing assembled on said bottom base; and, said transmission motor started to rotate clockwise by pressing the unlocking press button of a remote controller, said transmission motor actuating said connect ing rod to rotate together with said slide member, said notch of said slide member aligned to said engage block on said bottom base, letting said slide member no longer stopped by said engage block, said slide member together with said deadbolt able to be moved inward to compress said coil spring for performing unlocking of said remote-controlled lock, said transmission motor started to rotate counterclockwise by pressing the locking press button of a remote controller, said transmission motor actuating said connecting rod and said slide member to rotate reversely, said engage block on said bottom base engaged in said annular engage groove of said slide member, said slide member stopped from moving inward for performing locking of said remote-controller lock.

2. The remote-controlled lock as claimed in claim 1, wherein said slide member is bored with an accommodating chamber in the rear portion and said two lengthwise slide grooves pass through said accommodating chamber, said slide member is formed with a recessed hole in the front portion and bored with a pin hole in the front wall, and an insert pin is inserted through said pin hole to fix said deadbolt in said recessed hole of said slide member.

3. The remote-controlled lock as claimed in claim 1, wherein said deadbolt has its inner end cut with an annular groove and has its front head formed with an arc-shaped surface.

* * * * *